United States Patent [19]

Fujimoto et al.

[11] Patent Number: 4,910,837

[45] Date of Patent: Mar. 27, 1990

[54] LOOMING APPARATUS FOR A LOOM

[75] Inventors: Tetsunori Fujimoto; Hajime Suzuki, both of Kariya, Japan

[73] Assignee: Kabushiki Kaisha Toyoda Jidoshokki Seisakusho, Kariya, Japan

[21] Appl. No.: 25,512

[22] Filed: Mar. 13, 1987

[30] Foreign Application Priority Data

| | | | |
|---|---|---|---|
| Mar. 17, 1986 | [JP] | Japan | 61-60398 |
| Aug. 7, 1986 | [JP] | Japan | 61-185629 |
| Oct. 15, 1986 | [JP] | Japan | 61-244931 |

[51] Int. Cl.[4] ..... B65H 67/06

[52] U.S. Cl. ..... 28/208; 28/201; 139/1 R

[58] Field of Search ..... 28/201, 208; 139/1 R

[56] References Cited

U.S. PATENT DOCUMENTS

| | | | |
|---|---|---|---|
| 2,193,047 | 3/1940 | Truitt et al. . | |
| 2,424,400 | 7/1947 | Kronoff | 139/1 R |
| 2,624,476 | 1/1953 | Schmidt | 28/201 X |
| 2,706,056 | 4/1955 | Talley et al. . | |

FOREIGN PATENT DOCUMENTS

| | | | |
|---|---|---|---|
| 549808 | 5/1932 | Fed. Rep. of Germany | 28/201 |
| 2417476 | 10/1975 | Fed. Rep. of Germany | 28/201 |
| 7715780 | 1/1978 | Fed. Rep. of Germany . | |
| 2829111 | 1/1980 | Fed. Rep. of Germany | 28/208 |
| 2853907 | 6/1980 | Fed. Rep. of Germany | 28/201 |
| 158495 | 10/1963 | U.S.S.R. | 28/201 |
| 342971 | 7/1972 | U.S.S.R. | 28/201 |

OTHER PUBLICATIONS

Genkinger-Picanol Mechanical Handling in Weaving Mills, Genkinger Hebe-und Fordertechnik Gmbh, Postfach 1120, 7420 Munsingen/Wurtt.

*Primary Examiner*—Werner H. Schroeder
*Assistant Examiner*—Bradley K. DeSandro
*Attorney, Agent, or Firm*—Brooks Haidt Haffner & Delahunty

[57] ABSTRACT

A looming apparatus for a loom includes in general a warp beam handling unit for attaching and removing a warp beam to and from the loom, and a handling unit for supporting loom components including at least heddles and a reed threaded by the warp from the warp beam. A supporting platform is provided on a truck so as to be reciprocated between a stand-by position and a looming position. The warp beam handling unit and the handling unit for supporting the components threaded by the warp yarn are installed on this supporting platform. In the working position of the truck for the loom, the supporting platform is expanded from the truck to the looming position on the loom for performing the required operation at this position. After termination of such operation, the supporting platform is returned to the stand-by position on the truck, while the truck is moved to the looming preparatory position.

10 Claims, 16 Drawing Sheets

1
2
5
9
28
30
32
34
36
38
43
45
47
51
53
55A
56A
57
62
62a
62b
63
65A
66
68
68a
68b
69
70
71A
71B
72
73
74
49A

LOOMING APPARATUS FOR A LOOM

BACKGROUND OF THE INVENTION

1. Field of the Invention

This invention relates to a looming apparatus for a loom that is used when attaching or removing the warp beam and elements threaded by the warp to and from the loom.

2. Description of the Prior Art

In the operation of attaching the warp beam to the loom and threading the warp thereof through certain elements of the loom, herein termed as a "looming" operation, it has been customary to resort to an operational procedure in which the warp of a new warp beam is threaded through heddles and a reed in advance of attachment of the new warp beam in order that the time involved in the looming operation may be reduced thereby improving the operational efficiency. By using such operational procedure, it is no longer necessary to connect each warp yarn from the warp beam with each warp yarn of the woven cloth on the loom so that the time necessary for the looming operation may be reduced.

An example of a looming apparatus for mounting on the loom the warp beam and certain elements threaded by its warp, including heddles, a reed and a dropper box, is disclosed in the Japanese Patent Publication No. 53899/1982. With this known apparatus, the warp beam may be mounted to and supported by a manually operated truck, while the heddles are suspended and supported by a heddles suspension arm mounted on the truck to be vertically movable, with the suspension arm being extended and retracted between the truck and the loom. The warp beam and the elements threaded by the warp yarn are mounted on the truck by a sequence of operations similar to that used for mounting these elements on the loom, so that transfering or unloading from the truck to the loom is facilitated.

However, when unloading the warp beam and the elements threaded by the warp from the truck to the loom, the truck as a whole needs to be drawn near the loom. To this end, it is necessary to take such measures as shown in FIGS. 2 and 3 of the above patent publication, according to which a recess or cut-out is formed in the truck for introducing the frame of the loom into the recess without interference with the frame. However, in this case, there is a risk that interference may still be caused in the loom especially when the truck is moved manually. In addition, even after the truck is moved near to the loom, it is still necessary to resort to manual operation when unloading the warp beam, so that problems are presented as to safety and the necessity of manual operation.

In general, the truck is transported in a direction orthogonal to the cut-out or recess. Thus, in order that the truck may be moved near to the loom, it is necessary to divert the truck in a direction normal to the truck transport direction. For diverting the transport direction in this manner, it is necessary to change the guide direction of the truck castors. Such a change of the castor direction while the truck is stationary often leads to damage to the castors or the castor direction change mechanism due to the heavy weight of the warp beam and the truck. Moreover, considerable manual labor is involved in manually transporting the truck loaded with a heavy warp beam, while it is not possible to reliably prevent interference between the loom components and the truck components.

SUMMARY OF THE INVENTION

In consideration of the above described status of the prior art, a looming apparatus constructed according to the teachings of the present invention generally includes warp beam handling means for mounting the full warp beam on the loom and removing the empty warp beam therefrom, and means for handling the elements threaded by the warp from the warp beam, that is, at least the heddles and the reed. A movable or extendable supporting platform is mounted on the carrier or truck so as to be movable back and forth between a stand-by position and a looming position. The means for handling the warp beam and the elements threaded by the warp yarn are installed on this supporting platform.

In the working position of the carrier or truck in relation to the loom, the supporting platform is thrust from the truck towards the loom. In such manner, the means for handling the warp beam and the elements threaded by the warp yarn are disposed at the prescribed looming position on the truck, while the empty warp beam and the elements on the loom are transported respectively to the warp beam handling means and the means for handling the elements. After transferring from the loom to the supporting platform, the latter is returned to the stand-by position on the truck, which is in turn transported to a prescribed position. When the truck loaded with the full warp beam and the elements threaded by the warp yarn from the warp beam reaches the prescribed working position, the supporting platform extends from the truck towards the loom. Thus, the warp beam handling means and the handling means for the elements threaded by the warp yarn are placed at the looming position in the same manner as described above. After the full warp beam and the elements threaded by the warp yarn are transferred to the loom, the supporting platform is returned to the stand-by position on the truck, which is in turn moved to the prescribed position. Since the two functions of transport and transfer are separately filled by the transportation truck and the transfer supporting platform, the truck may be accurately set at the prescribed working position with respect to the loom, so that the platform can be moved towards the loom under such optimum positioning without interfering with the loom. Thus the warp beam handling means and the means for handling the elements threaded by the warp yarn are at a position convenient for the transfer with respect to the loom, while the truck can be moved without relying upon manual operation.

According to a preferred embodiment of the present invention, the warp beam handling means includes a first warp beam handling mechanism for handling the warp beam between a placement position on the truck and a provisional placement position ahead of the warp beam mounting position in the loom and a second warp beam handling mechanism for handling the warp beam between the provisional placement position and the warp beam mounting position. In the present modification, the second warp beam handling mechanism is actuated when the truck is at the working position with respect to the loom, so that the empty warp beam on the loom is moved from the warp beam attachment position in the loom to the provisional placement position. The first warp beam handling mechanism is then actuated so that the empty warp beam at the aforementioned provisional position is moved therefrom to the warp beam placement position on the looming apparatus. After the empty warp beam has been moved from the loom onto the looming apparatus, the latter thus loaded with the empty warp beam is moved to a prescribed position. As the looming apparatus loaded with the full warp beam reaches the prescribed working position, the first warp beam handling mechanism is actuated so that the full warp beam placed on the looming apparatus is moved to the provisional placement position on the loom. The second warp beam handling mechanism is actuated so that the full warp beam disposed at the provisional placement position is moved to the attachment position on the loom.

In the arrangement of the present invention, the two consecutive temporary operations, namely the movement between the placement position on the looming apparatus and the provisional placement position on the loom and the transport between the latter position and the attachment position, are separately filled by the first and the second handling mechanisms. A higher degree of freedom in the selection of the transport routes of the first and second handling mechanisms for transporting the warp beam in the respective operations may be achieved for avoiding the interference with the loom components during transfer of the warp beam. In addition, the warp beam can be transported without manual operation throughout the whole route between the placement position on the looming apparatus and the attachment position on the loom so that a saving in man-power and improvement in operational safety may be achieved.

These and other advantages and attainments of the present invention will become apparent to those skilled in the art upon reading the following detailed description when taken in conjunction with the drawings wherein there are shown and described illustrative embodiments of the invention.

BRIEF DESCRIPTION OF THE DRAWINGS

In the course of the following detailed description, reference will be made to the attached drawings, in which.

DESCRIPTION OF THE PREFERRED EMBODIMENT

Figure 1:
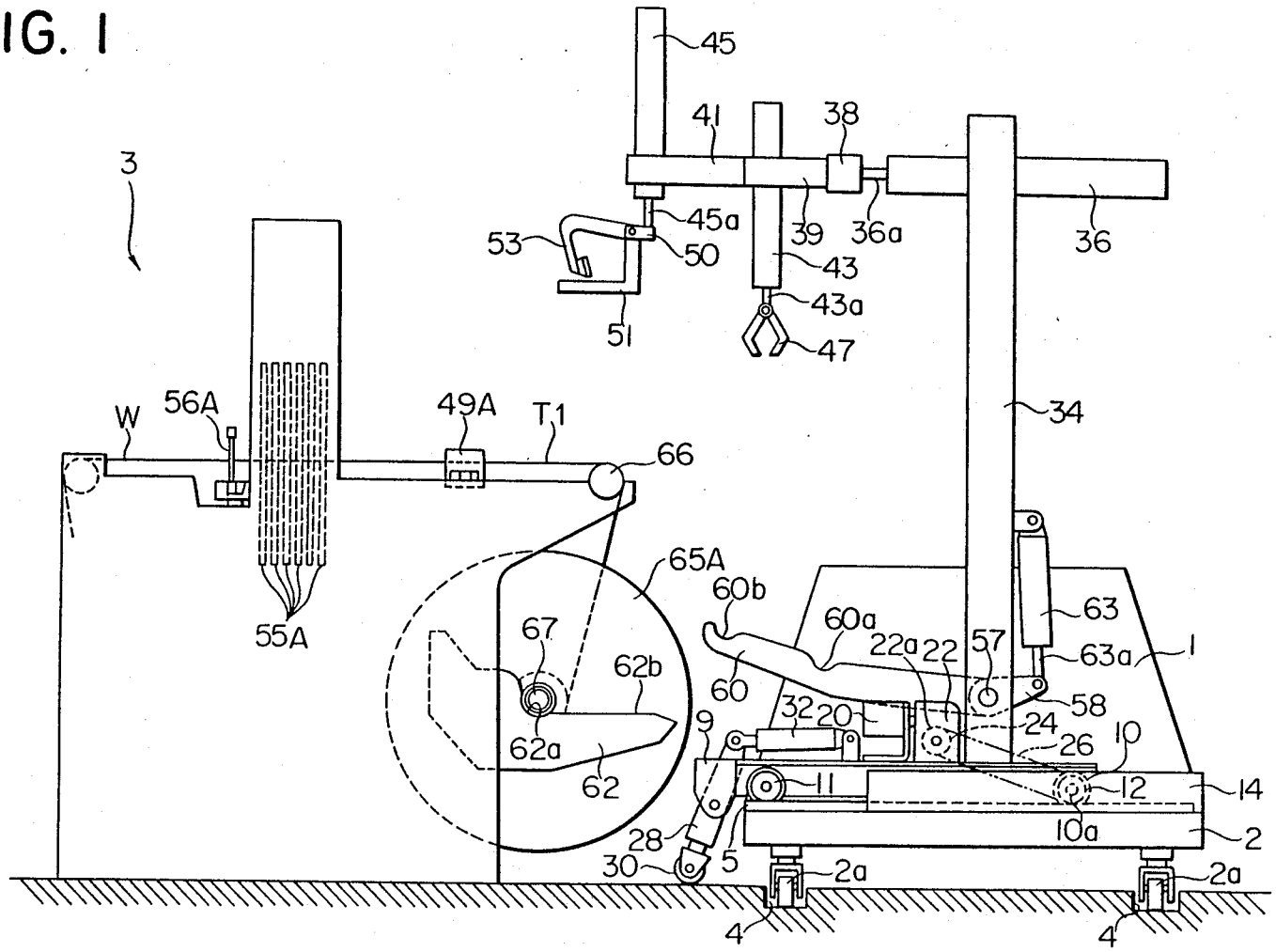
FIG. 1 is a diagrammatic side view showing an embodiment of the looming apparatus of the present invention when in the working position with respect to the loom.
Figure 2:
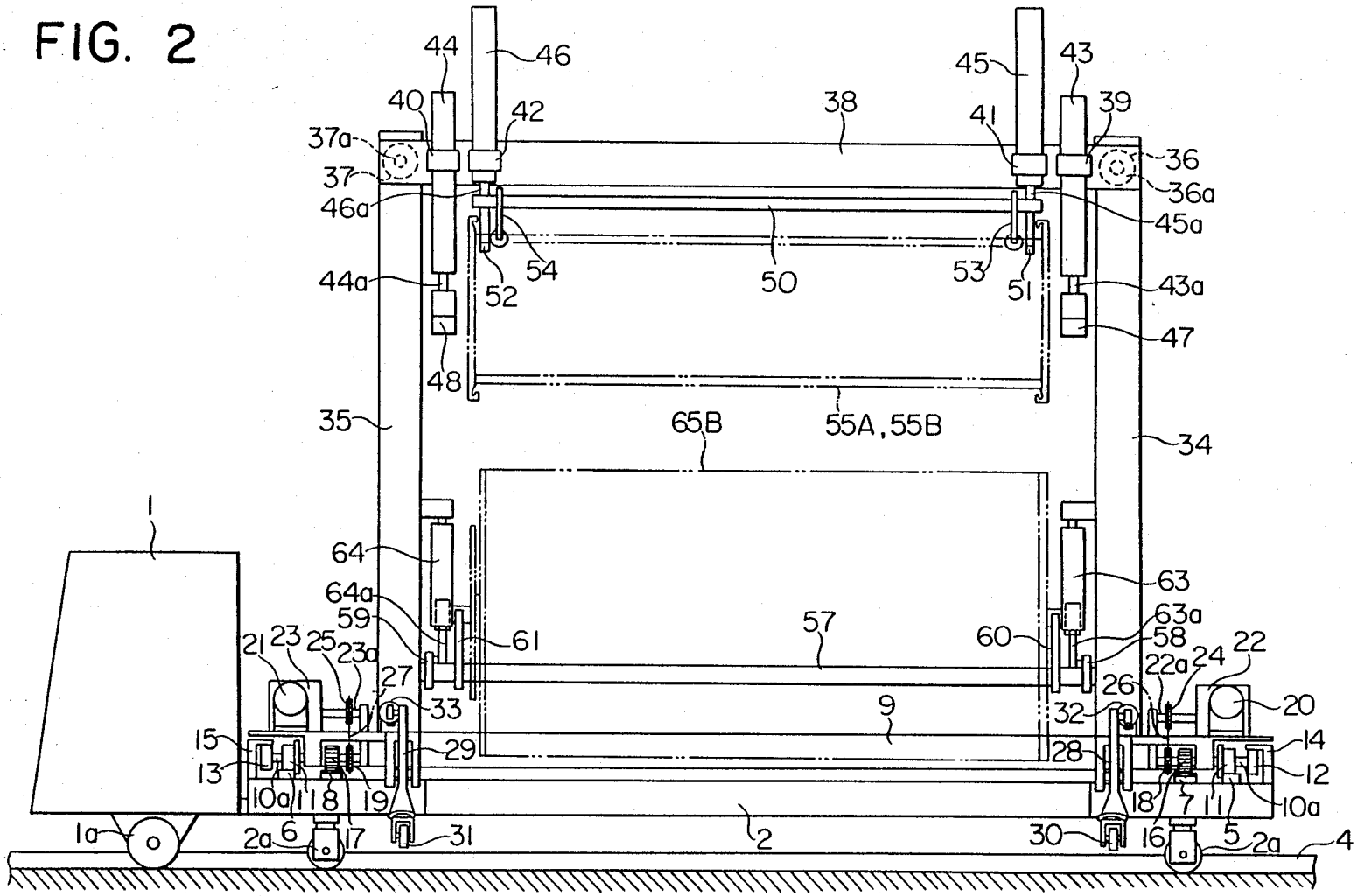
FIG. 2 is a front view of the looming apparatus shown in FIG. 1.

As shown in FIGS. 1 and 2, an unmanned towing vehicle 1 and a truck 2 towed by the vehicle 1 and being U-shaped when seen in plan view, are driven with wheels la of the vehicle and castors 2*a* of the truck 2 being guided along grooved rails 4 passing in the vicinity of the prescribed working position at the back of a loom 3, and are adapted to be halted at the working position by a signal from halt position sensing means (not shown). On the upper surface on the left and right sides of the truck 2 when viewed in FIG. 2, rails 5, 6 and racks 7, 8 are juxtaposed in the fore and aft direction or in the left-and-right direction in FIG. 2. A supporting platform 9 having the shape of a letter U in plan view is placed on the rails 5 and 6 so as to be moved in a direction transverse to the transport direction of the truck 2 by wheels 10 and 11. At the outer extreme ends of an axle 10*a* of the rear wheel 10, rollers 12 and 13 are supported for rolling on the lower surface of hold-down rails 14 and 15 mounted upright on the left and right extreme ends of the truck 2 for regulating the supporting platform 9 against disengaging upwardly. At the inner ends of the wheel axle 10*a*, pinions 16, 17 and sprocket wheels 18, 19 are fastened in juxtaposition to the inner ends of the wheel axle 10*a*, with the pinions 16 and 17 meshing with the racks 7 and 8. On the left and right sides of the upper surface of the supporting platform 9, there are provided reversible hydraulic motors 20 and 21. Sprocket wheels 24 and 25 are fastened to output shafts 22*a* and 23*a* of speed-reducing gearing units 22 and 23 adapted to transmit the driving power of the motors 20 and 21. The sprocket wheels 24 and 25 above the platform 9 and the sprocket wheels 18 and 19 below the platform 9 are operatively connected to each other by chains 26 and 27 so that the driving power of the hydraulic motors 20 and 21 is transmitted to the sprocket wheels 18 and 19.

On the front sides of both extreme ends of the platform 9, foot levers 28 and 29 are supported for rotation in the fore-and- aft direction. Castors 30, 31 are attached to the lower ends of these foot levers 28 and 29. These foot levers are regulated in their rotational positions by hydraulic cylinders 32 and 33. Usually, these foot levers are regulated so as to be in the out-of-the-way position shown in FIG. 1.

At the left and right ends of the platform 9, there are mounted upright supporting posts 34 and 35, and hydraulic cylinders 36 and 37 are passed through the upper ends of these supporting posts 34 and 35 for extending in the fore and aft direction. A supporting bar 38 is mounted across driving shafts 36*a* and 37*a* of the hydraulic cylinders 36 and 37 while four supporting brackets 39, 40, 41 and 42 are protrudingly provided to the front side of the supporting bar 38. The outer two supporting brackets 39 and 40 are of a shorter length than the inner supporting brackets 41 and 42. To the foremost parts of the brackets 39 to 42, hydraulic cylinders 43, 44, 45 and 46 are attached so as to be directed downward. Grippers 47 and 48 are mounted to the ends of drive rods 43*a*, 44*a* of the outer cylinders 43 and 44 so as to be movable by any suitable means between the gripping position and the release position. When in the gripping position, these grippers grip the ends of a dropper unit 49A adapted for sensing the warp breakage in the loom 3. A rod 50 is mounted between the ends of driving rods 45*a*, 46*a* of the inner hydraulic cylinders 45 and 46. To both ends of the rod 50 are attached angled engaging members or supporting hooks 51 and 52 while presser arms 53 and 54 are biased to be turned towards these hooks 51 and 52 so as to be releasably pressed by any suitable means (not shown). Both ends of heddles 55A on the loom 3 are engaged with or supported by these supporting hooks 51 and 52. Together with the heddles 55A, a reed 56A on the loom 3 is pressed against and held by the supporting hooks 51 and 52 by these presser arms 53 and 54.

The relative position between these grippers 47, 48 and the supporting hooks 51, 52 is set so as to be similar to that between the heddles 55A and the dropper unit 49A on the loom.

A shaft 57 is rotatably mounted between the distal ends of the supporting posts 34 and 35 while levers 58, 59 and transfer levers 60, 61 are secured to both ends of the shaft 57. On the upper edges of the transfer levers 60 and 61 are formed first supporting grooves 60*a*, only one being shown, and second supporting grooves 60*b*, also only one being shown. The distance between these grooves is set so as to be equal to that between a warp beam attachment position 62*a* and provisional warp beam placement position 62*b* of a pair of warp beam supporting brackets 62, only one being shown, on the beam 3. Hydraulic cylinders 63 and 64 are attached to the rear surfaces of the supporting posts 34 and 35, with driving rods 63*a*, 64*a* thereof being connected to the levers 58 and 59. The transfer levers 60 and 61 are regulated by the hydraulic cylinders 63 and 64 so as to be normally in the stand-by position shown in FIG. 1.

The hydraulic motors 20, 21 and the hydraulic cylinders 32, 33, 36, 37, 43, 44, 45, 46, 63 and 64 are controlled by actuating switches, not shown, on a control device, also not shown, on the unmanned towing vehicle 1.

The operation of the looming apparatus of the present invention when it is in the situation in which a warp yarn T1 supplied from a warp beam 65A mounted on supporting brackets 62 as shown in FIG. 1 and passed by way of a back roller 66 through the dropper unit 49A, heddles 55A and the reed 56A, is used up, so that it becomes necessaary to perform the looming operation, is hereafter explained.

Figure 3:
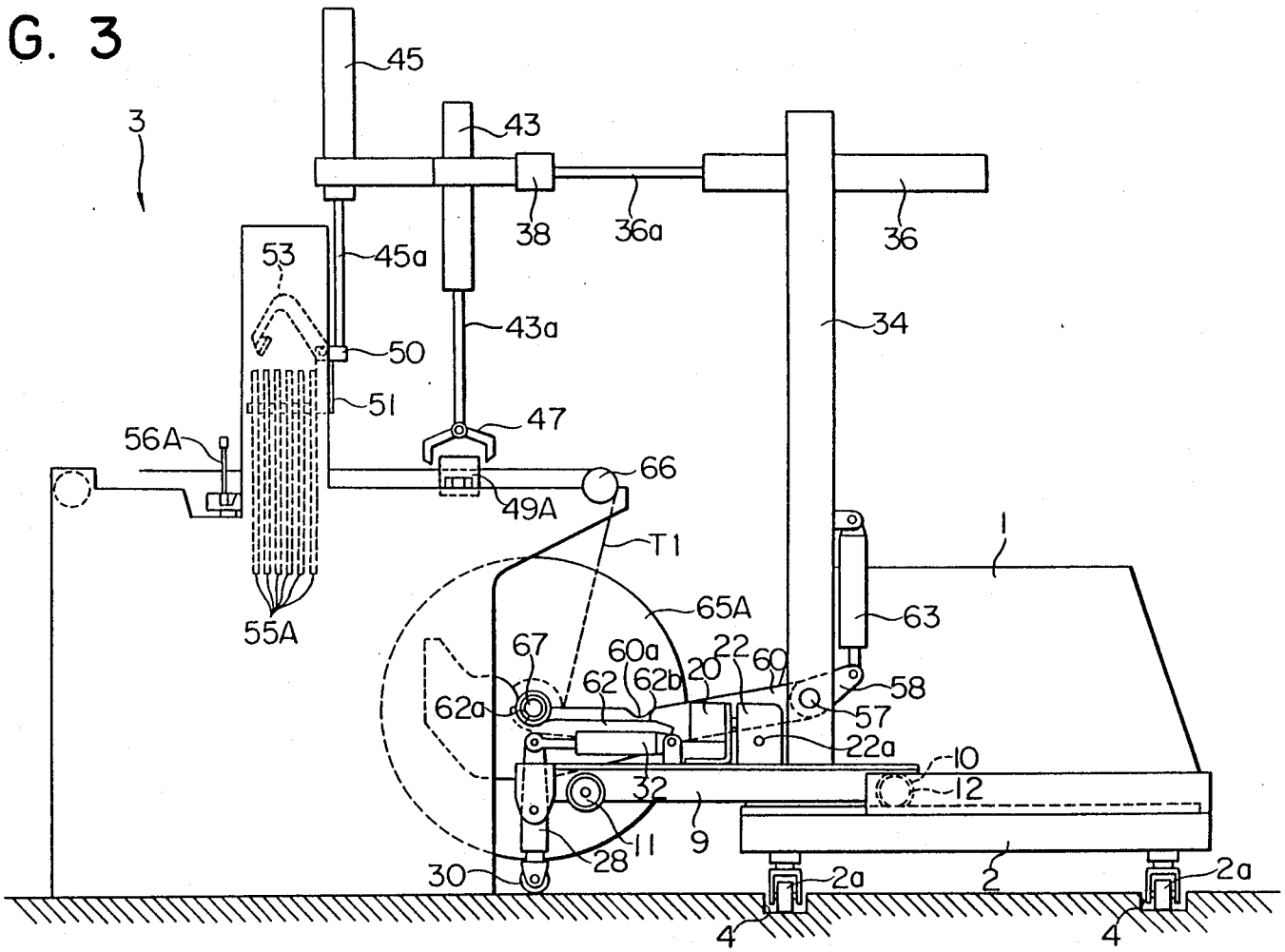
FIGS. 3 to 6 are side views showing various states in the course of the transfer of the empty warp beam from the loom to the looming apparatus.
Figure 4:
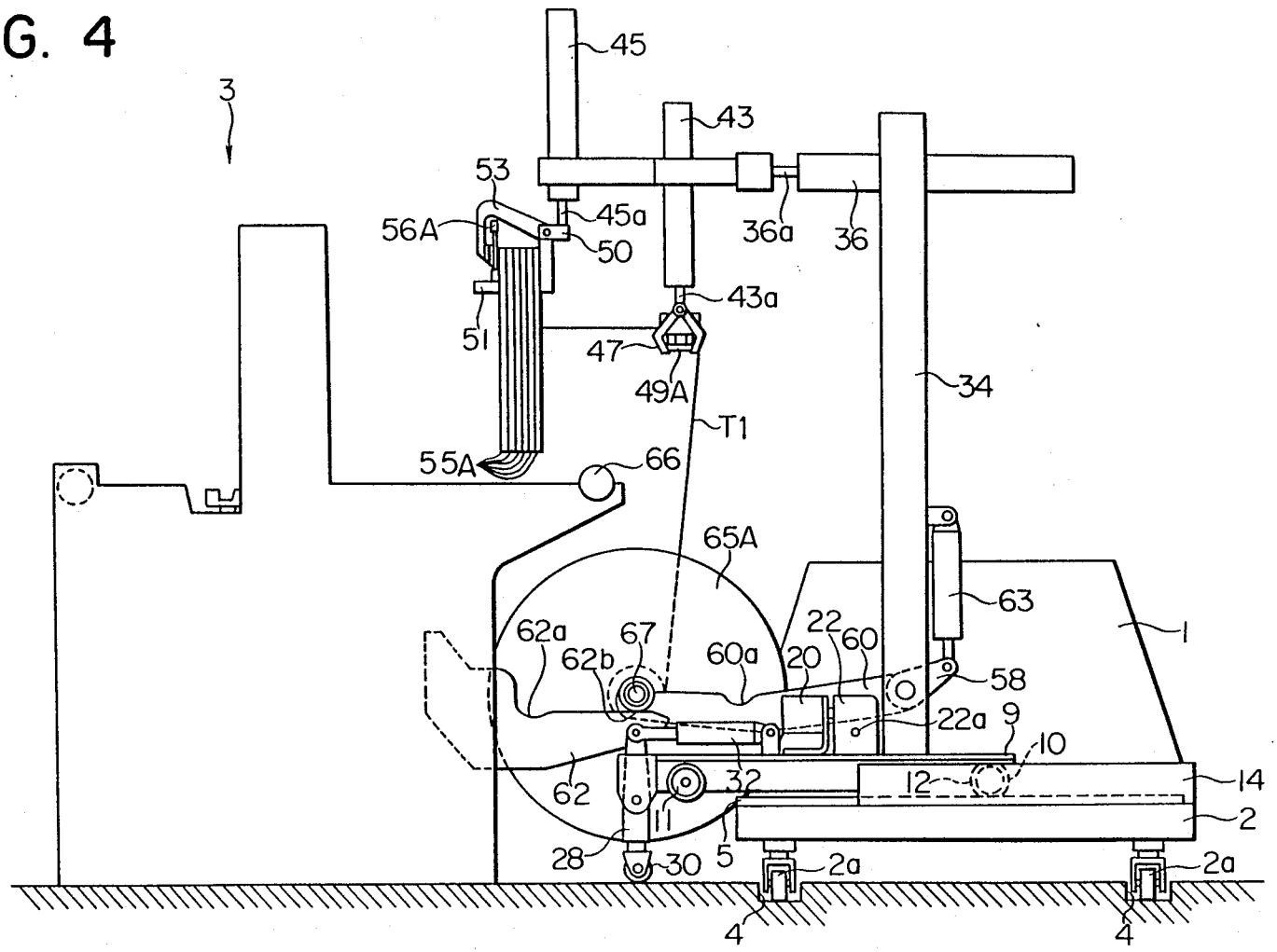

The looming apparatus, so far kept within a ready chamber or station (not shown), is moved along the grooved rails 4 to the working position at the back of the loom 3, in the state as shown in FIG. 1. In this working position, the hydraulic cylinders 32 and 33 are operated so that the castors 30 and 31 of the foot levers 28 and 29 are placed on the floor. The hydraulic cylinders 20 and 21 are then driven in the forward direction such that the supporting platform 9 is moved from the stand-by position shown in FIG. 1 along the rails 5 and 6 on the carrier track 2 towards the loom 3. During such movement, the hydraulic cylinders 63 and 64 are actuated such that the supporting grooves 60*b* in the forward ends of the transfer levers 60, 61 are moved to a position lower than the warp beam shaft 67 of the empty warp beam 65A on the loom 3. Simultaneously, the hydraulic cylinders 36, 37, 43 44, 45 and 46 are actuated such that the grippers 47, 48 and the presser arms 53, 54 are lowered while being also protruded moderately towards the loom in the opened position shown in FIG. 3. When the platform 9 is extended to a looming position from the truck 2 shown in FIG. 3, the grippers 47 and the supporting hooks 51, 52 are at their looming positions, that is, a position directly above both ends of the gripper unit 49A and a position engageable with the heddles 55A, respectively, with the supporting grooves 60*b* in the transfer levers 60 and 61 disposed directly below the warp beam shaft 67.

After the supporting platform 9 is moved to the looming position thereof on the truck 2, loom elements threaded by the warp yarn, namely the dropper unit 49A, heddles 55A and the reed 56A, are disengaged manually from the loom 3, while a woven cloth W ahead of the reed 56A is disconnected and separated from a take-up roller, not shown. The dropper unit 49A is gripped by the grippers 47 and 48, while the heddles 55A and the reed 56A are pressed towards and held by the presser arms 53 and 54. The hydraulic cylinders 36, 37, 43, 44, 45 and 46 are then actuated so that the grippers 47, 48 and the supporting hooks 51, 52 are returned to the stand-by position, FIG. 1, with respect to the platform 9 and the supporting posts 34 and 36.

Figure 5:
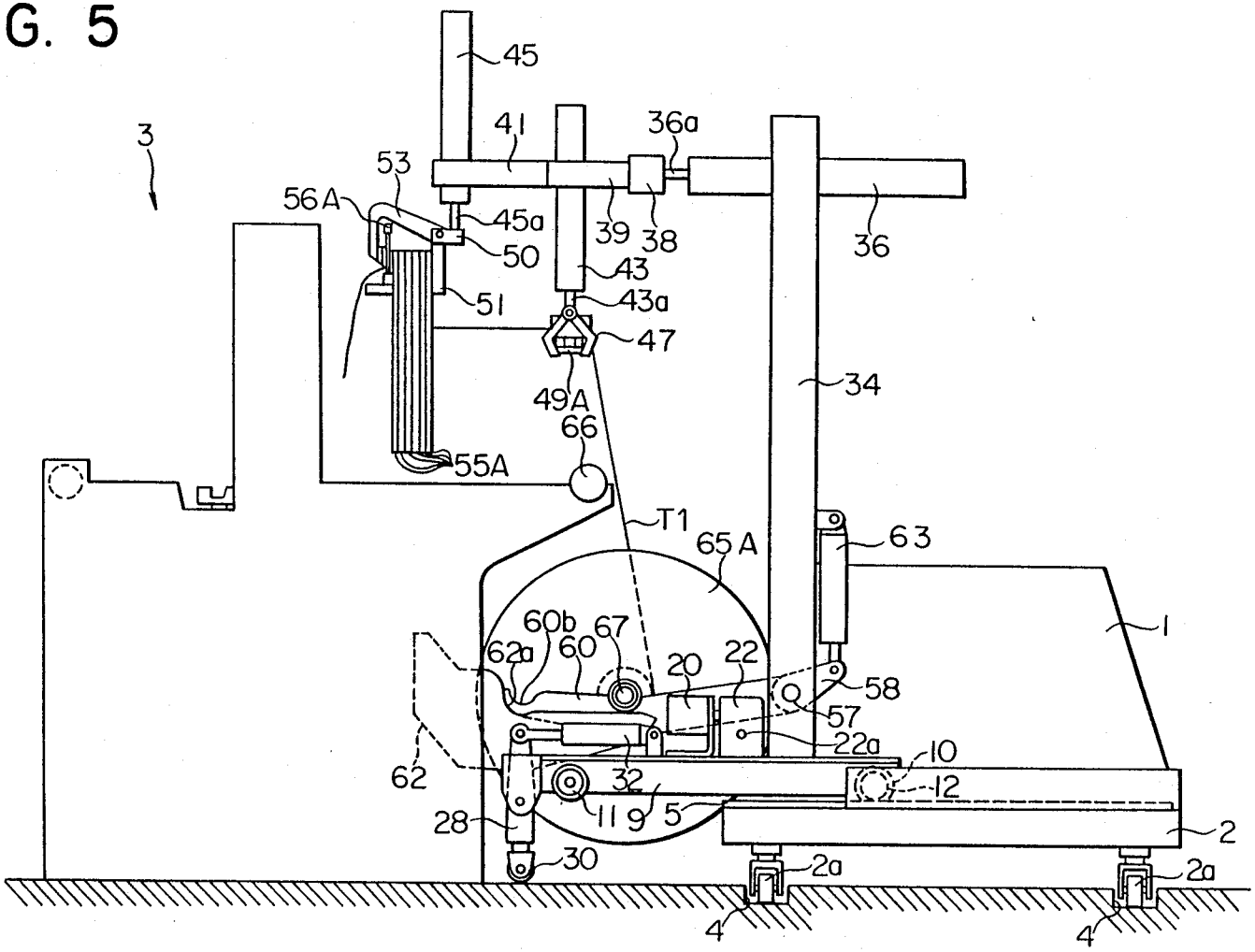
Figure 6:
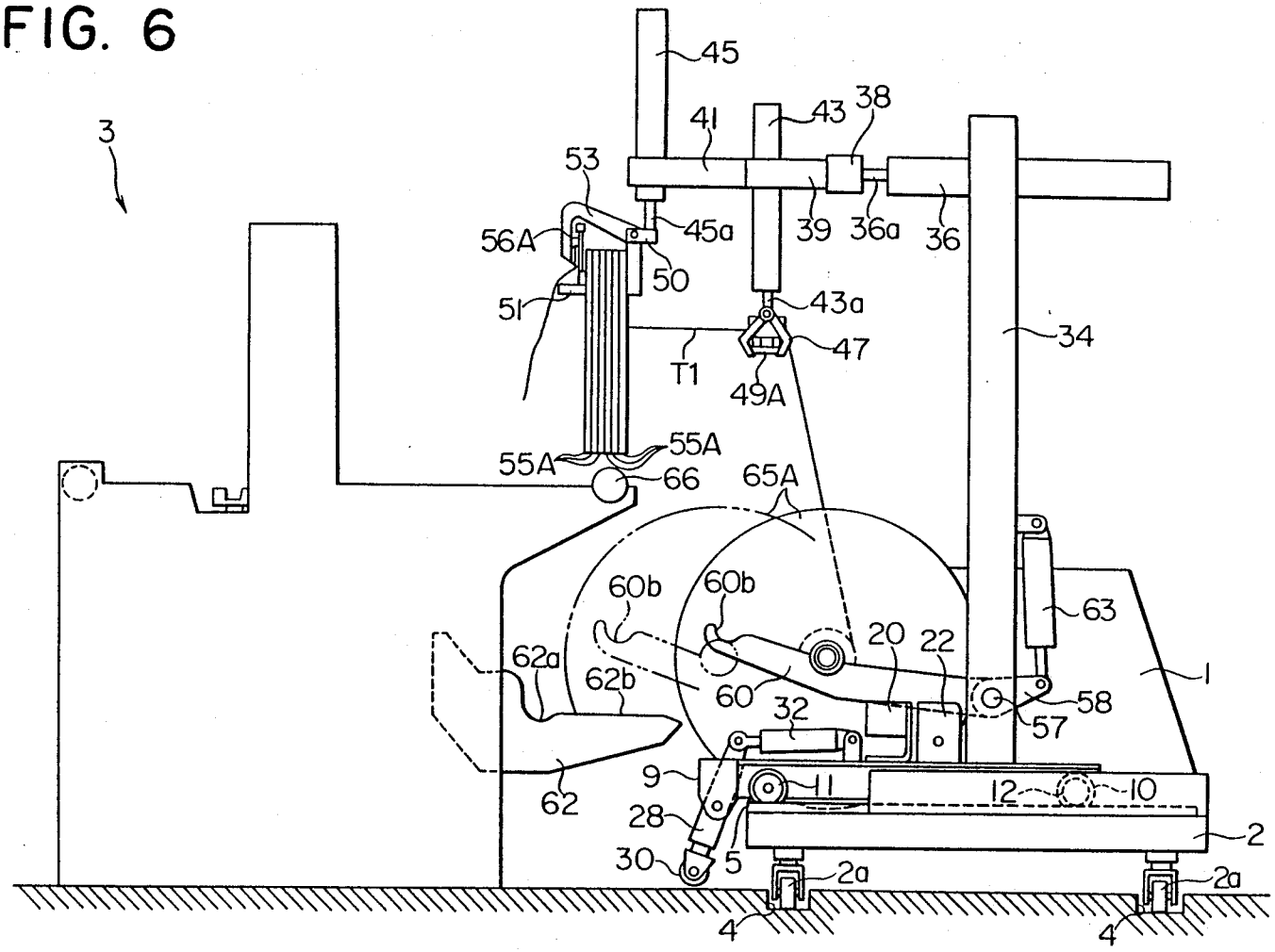

Then, by the operation of the hydraulic cylinders 63 and 64, the transfer levers 60, 61 are raised slightly, the warp beam shaft 67 engaging with the supporting groove 60*b*. In this state, the hydraulic motors 20 and 21 are driven in reverse, such that the platform 9 is returned to an intermediate position which is further to the rear by only the interval between the attachment position 62*a* and the provisional placement position 62*b* on the supporting bracket 62. By the operation of the hydraulic cylinders 63 and 64, the transfer levers 60 and 61 are lowered and the empty warp beam 65A is placed at the provisional position 62*b*. By the operation of the transfer levers 60 and 61, supporting grooves 60*a* of the levers 60 and 61 are lowered to a position below the warp beam shaft 67 of the warp beam 65A. In this state, the hydraulic motors 20 and 21 are driven in the normal direction so that the supporting platform 9 protrudes from the intermediate position on the truck 2 to the looming position. In this looming position, the hydraulic cylinders 63 and 64 are actuated so that the supporting grooves 60*a* on the transfer levers 60 and 61 are engaged with the warp beam shaft 67, as shown in FIG. 5. After such engagement, by the operation of the hydraulic cylinders 63 and 64 and by the reverse operation of the hydraulic motors 20 and 21, the empty warp beam 65A is transferred from the provisional position through a position represented by a broken line (FIG. 6) to a solid-line position in which it is placed on the truck 2.

After the transfer operation of the elements 49A, 55A and 56A and the empty warp beam 65A, the castors 30, 31 are moved from their position on the floor to their stand-by position, by the operation of the hydraulic cylinders 32 and 33, while the looming apparatus is transported into the ready chamber.

Figure 7:
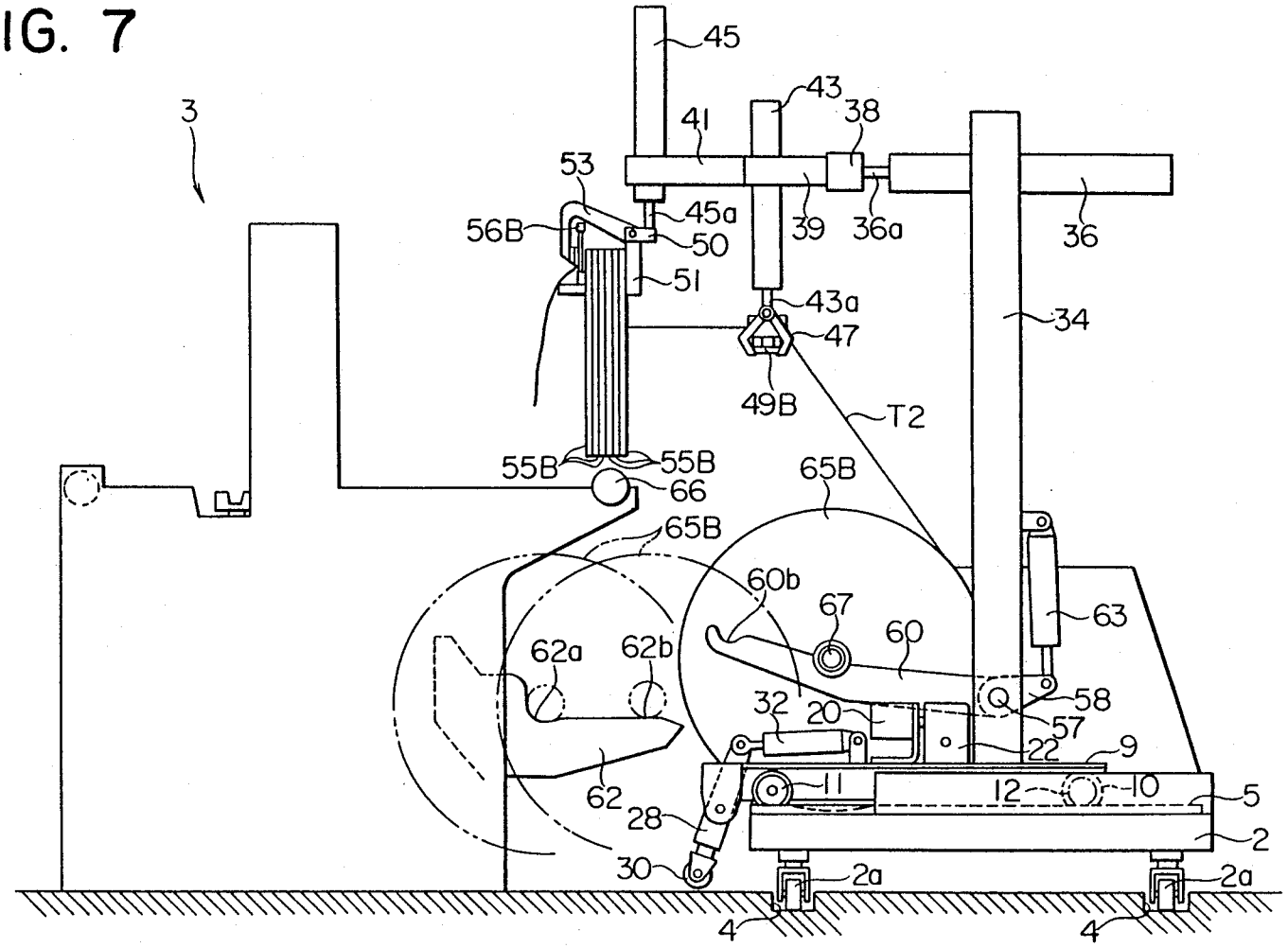
FIG. 7 is a side view showing the looming apparatus fitted with the full warp beam and the elements threaded by the warp yarn.

In this ready chamber, the empty warp beam 65A, dropper unit 49A, heddles 55A and the reed 56A attached to or placed on the looming apparatus are replaced by a full warp beam 65B, a dropper unit 49B, heddles 55B and a reed 56B threaded by a warp yarn T2 wound on the beam 65B. In this state, the looming apparatus is moved back to the working position at the rear of the loom 3 as shown in FIG. 7, and the casters 30 and 31 of the foot levers 28 and 29 are put in contact with the ground. In this state, the supporting platform 9 is reciprocated between the stand-by position on the truck 2 and the intermediate position so that the full warp beam 65B placed on the truck 2 is placed at the provisional placement position **62*b*. Then, as the supporting platform 9 is extended from its stand-by position on the truck 2 to the looming position, the full warp beam 65B is moved from the provisional placement position 62*b* to the attachment position 62*a*. The grippers 47, 48 and the supporting hooks 51, 52 are placed at the looming position while the elements 49B, 55B and 56B are transferred from the looming apparatus towards the loom 3. The transfer levers 60, and 61 are moved along a route that is the reverse of the take-out route of the empty warp beam. After the transfer operation is terminated, the supporting platform 9 is returned to the stand-by position on the truck 2**, while the looming apparatus is returned into the ready chamber.

In the present embodiment, the two shifting functions, namely the functions of transporting and transferring the warp beam and the elements threaded by the warp yarn, are separately filled by the truck moved along the grooved rails and by the supporting platform on the truck, such that the truck can be accurately positioned at the prescribed working position relative to the loom and the supporting platform can be expanded towards the loom under such optimum positioning without colliding against the loom. In such manner, the supporting levers as the warp beam handling or transfer means and the supporting hook as the handling or transfer means for the elements threaded by the warp yarn may be set to an optimum position for transfer relative to the loom, so that a smooth transfer operation of the warp beam and the elements threaded by the warp yarn may be attained between the loom and the truck. In addition, the truck loaded with heavy articles can be transported without manual operation so that the operation efficiency may be improved. Also, in the present embodiment, the first warp beam handling mechanism for moving the supporting platform 9 between its stand-by position and the intermediate position and for supporting the warp beam by the first supporting grooves **60*a* of the transfer levers 60 and 61 is used to carry out the warp beam transfer between the attachment position at the looming apparatus and the provisional placement position 62*b* at the loom 3. On the other hand, the second warp beam handling mechanism for moving the platform 9 between the intermediate position and the looming position and for supporting the warp beam by the second supporting grooves 60*b* of the transfer levers 60 and 61 is used to carry out the warp beam transfer between the provisional position 62*b* and the attachment position 62*a*. As a result, the degree of freedom in the selection of a warp beam transfer route free of collision with the loom 3 is increased, while an increase in size of the looming apparatus may be avoided. When the first supporting grooves 60*a* of the transfer levers 60 and 61 are eliminated, it is still possible to transfer the warp beam. However, if the heavy beam warp is perpetually supported by the second supporting grooves 60*b*, the center of gravity of the looming apparatus as a whole is markedly offset resulting in an increased instability, so that it becomes eventually necessary to maintain the stability of the looming apparatus by increasing the overall size of the apparatus. In the present embodiment, the first and the second warp beam mechanisms for handling the route ahead of position 62*b* and the route behind the position 62*b* are built into warp beam handling means comprised of the combination of the supporting platform 9 and the transfer levers 60 and 61**, so that stable warp beam transfer may be achieved by such route sharing. In addition, since manual operation is not required in transferring the heavy warp beam, a saving in manual labor and improved safety may be achieved.

Figures 8, 9:
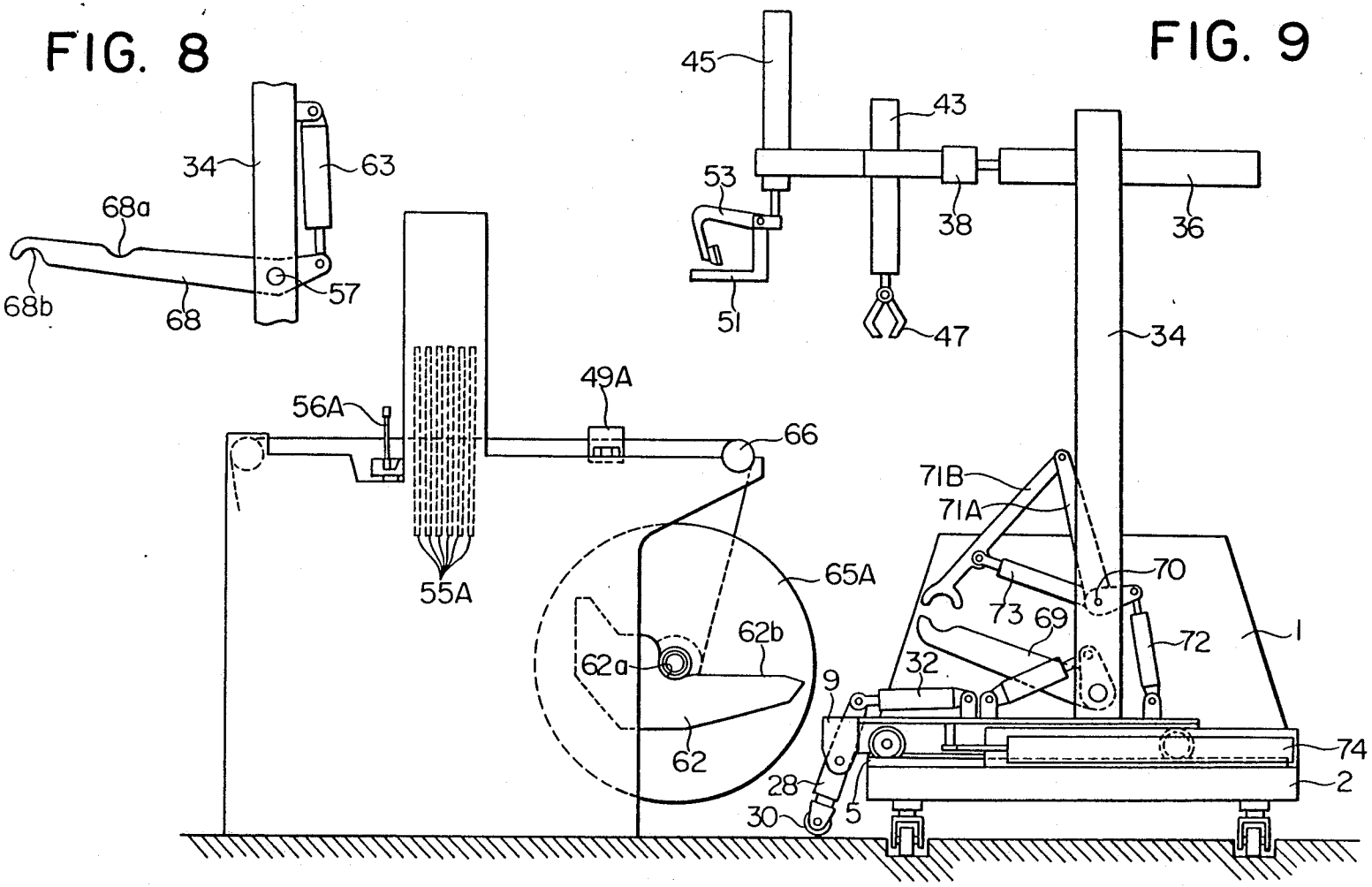
FIG. 8 is a side view showing a modified transfer lever.
FIG. 9 is a side view showing modifications of the first and second warp beam handling mechanisms.

The present invention is not limited to the above described embodiment. For example, the transfer lever may be modified as shown in FIG. 8, wherein the supporting grooves **68*a* are for the route between the provisional position in the preceding embodiment and the warp beam attachment position at the looming apparatus, while the supporting grooves 68*b* for the rolling route on the supporting bracket 62 of the preceding embodiment and the first and the second warp beam handling mechanisms for separately handling the routes ahead and in back of the provisional position, may also be configured as shown in FIG. 9. In the present modified embodiment, the first transfer lever 69 is for handling the route between the looming apparatus and the provisional position 62*b* while the second transfer lever unit comprised of a lever 71A pivoted at a shaft 70 and a lever 71B pivoted to the end of the lever 71A is for the route between the provisional position 62*b* and the attachment position 62*a*. Pivoting of the lever 71A is controlled by a hydraulic cylinder 72, while pivoting of the lever 71B is controlled by a hydraulic cylinder 73 connected to shaft 70. The present modification also assures a higher degree of freedom in the route selection of the two transfer levers so that collision between the loom 3 and the warp beam or the transfer lever may be effectively avoided. In the present embodiment, the supporting platform 9 is shifted by a hydraulic cylinder 74**.

Figure 10:
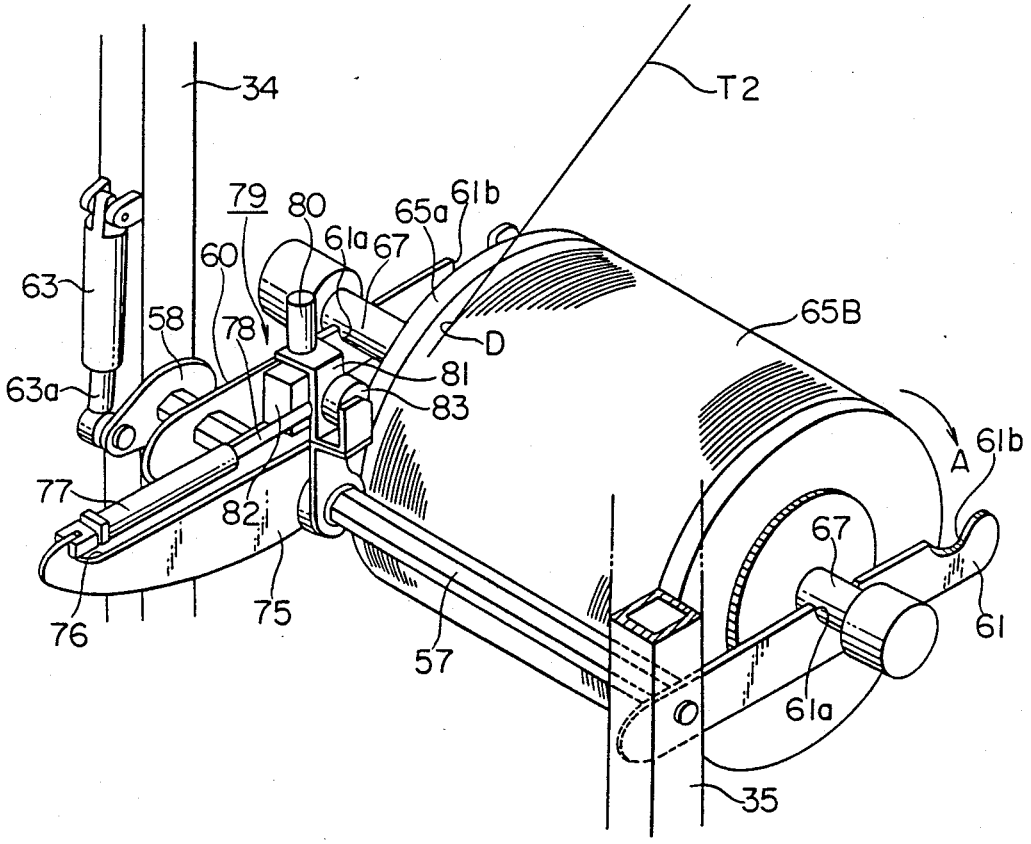
FIG. 10 is an enlarged perspective view showing the warp tension adjustment means together with the full warp beam, with part being broken away.

The looming apparatus of the present invention may be provided with a warp tension adjustment means as shown in FIG. 10, wherein the full warp beam is turned in the normal or reverse direction as a function of the magnitude of the tension on the warp yarn threaded through the aforementioned elements from the full warp beam.

Referring to FIG. 10, at the inner side of one supporting post 34, a fixed lever 75 has its one end fitted on a shaft 57, herein formed as a hexagonal shaft. A hydraulic cylinder 77 is mounted within a recess 76 formed in the upper side of the fixed lever 75. The forward end of a piston rod 78 of the hydraulic cylinder 77 is secured to a supporting bracket 81, while a warp tension adjustment means 79 is provided in the projecting direction of the piston rod 78. The warp tension adjustment means 79 is made up of a hydraulic motor 80 that may be driven in both the forward and reverse directions, a speed reducing unit 82 mounted to the motor 80 through a supporting bracket 81 and a friction roller 83 connected to the speed reducing unit 82. The friction roller 83 is designed to abut on one flange **65*a* of the full warp beam 65B. The hydraulic motor 80 and the hydraulic cylinder 77 are also controlled by the operation of a pushbutton switch (not shown), of a control unit, also not shown, on the unmanned towing vehicle 1**.

As may be seen from FIG. 7, in the course of the movement of the dropper unit 49B, heddles 55B and the reed 56B in the direction of the loom 3, the distance between the yarn release position on the full warp beam 65B and the yarn receiving position of the dropper unit 49B is changed, such distance becoming maximum when the dropper unit 49B reaches the mounting position at the loom 3. With such changes, the tension on the warp T2 between these two positions may be changed, thus occasionally causing the breakage of the warp yarn T2. In order to prevent this, the hydraulic motor 80 is driven in the normal direction with the start of the movement of the dropper unit 49B, so that the full warp beam 65B is turned in the direction of the arrow A through the friction roller 83 and the flange **65*a* for reeling out the warp T2 from the warp beam 65B. The aforementioned distance is also changed while the full warp beam 65B is moved from the placement position on the supporting platform 9 to the attachment position 62*a* through the provisional position 62*b* on the warp beam supporting bracket 62 on the loom 3, FIGS. 1 to 7. In such case, the hydraulic cylinder 77 is actuated by pushbutton actuation for shifting the warp tension adjustment means 79 so as to follow up with movement of the full warp beam 65B. Simultaneously, the hydraulic motor 80 is suitably driven to rotate the warp beam 65B** to adjust the tension placed on the warp yarn T2.

Since the supporting bracket 81 in the embodiment of FIG. 10 is rotated with the shaft 57, the friction roller 83 may be positively abutted on the flange **65*a* of the warp beam 65B irrespective of the positions assumed by the transfer lever 60**. the present embodiment may also be modified in such a manner that the tension on the warp between the dropper unit and the full ) warp beam is sensed by a tension sensor and a motor associated with the tension adjustment means is driven into rotation in the normal or reverse direction by a control unit in dependence upon electrical signals from the sensor for thereby rotating the full warp beam.

By the provision of such warp tension adjustment means, a substantially constant tension is provided at all times on the warp yarn between the elements threaded by the warp and the full warp beam so that yarn breakage due to excess tension or warp entanglement due to slack may be avoided. In such manner, the laborious and risky operation of directly rotating the warp beam by manual operation may be dispensed with.

According to a further embodiment of the looming apparatus of the present invention, the handling means for the elements threaded by the warp may be formed by a parallel motion link system. This system is explained by referring to FIGS. 11 to 13. A supporting bar 90 and a guide rod 91 are mounted and supported parallel to each other between the upper ends of the supporting posts 34 and 35. The guide rod 91 is arranged in a plane including a straight line connecting supporting shafts 94 and 95 mounted to the supporting bar 90. On the lower surface of the supporting bar 90, a pair of link arms 92 and 93 are carried for rotation by means of supporting pins 94 and 95. Link arms 96 and 97 are rotatably supported at the foremost parts of the link arms 92 and 93 by means of supporting pins 98 and 99, while a connecting link 100 is mounted between these supporting pins 98 and 99. To the lower surface of one 96 of the link arms 96 and 97, a drive link 101 is secured in alignment with the link arm 96, while a slider 101 is rotatably supported at the rear end of the link 102 by means of a supporting pin 103. The slider 102 is slidably supported by the guide rod 91. A connecting projection **102*a* is formed on the rear periphery of the slider 102. A reversible hydraulic motor 104 is attached to one supporting post 34, and a sprocket wheel 105 is supported for rotation by the other supporting post 35, while a chain 106 is placed between the wheel 105 and a driving sprocket wheel 104*a* of the hydraulic motor 104. The chain 106 is connected to the connecting projection 102*a*. On actuation of the hydraulic motor 104, the slider 102 is slid towards left or right along the guide rod 91**.

Figure 13:
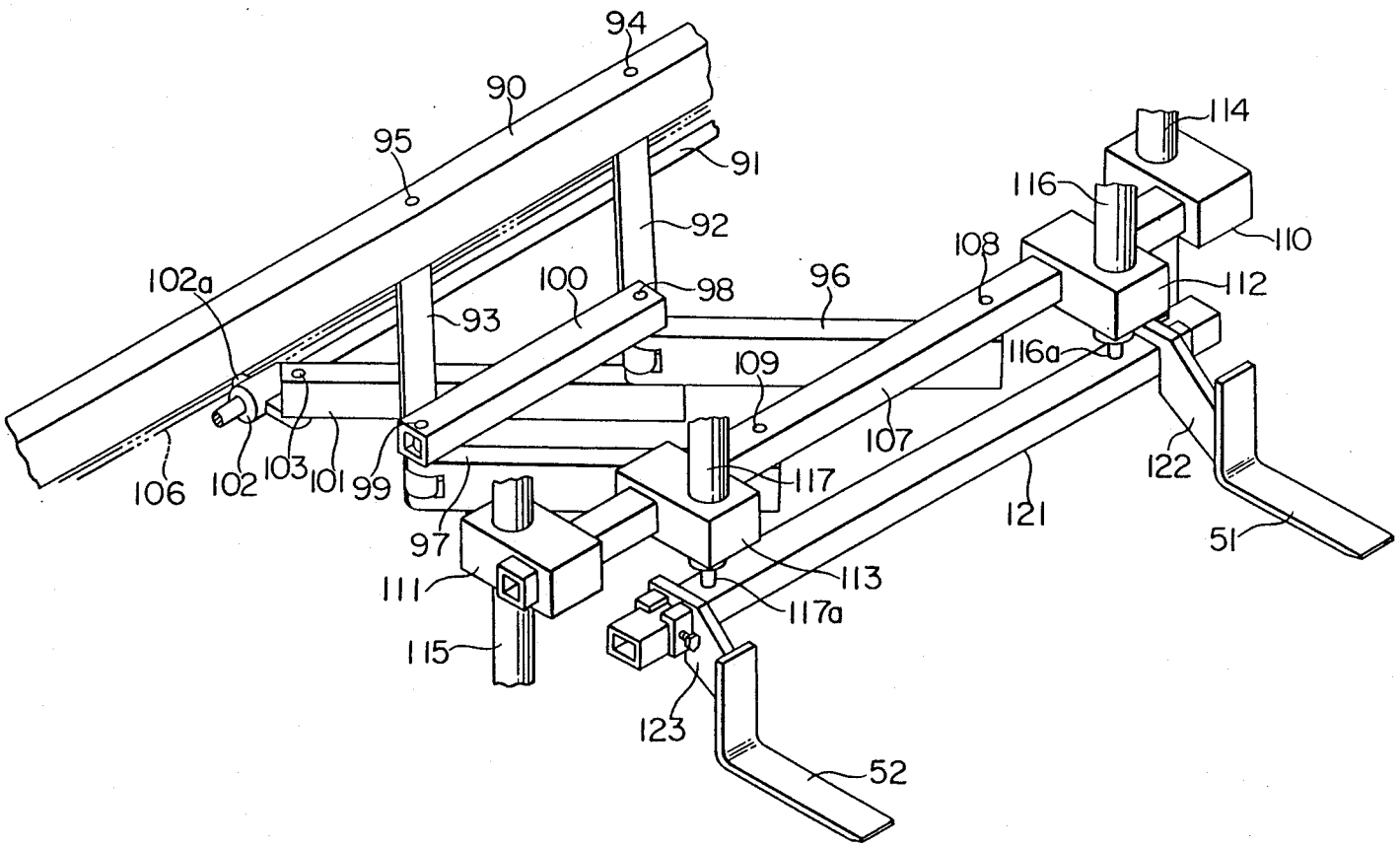
FIG. 13 is a perspective view showing essential parts of a six-member parallel-motion link system of the looming apparatus shown in FIG. 11, the apparatus being shown at the stand-by position.

On the front upper sides of the forward link arms 96 and 97, a supporting link 107 is mounted and supported by means of supporting pins 108 and 109. To both ends of the supporting link 107, two pairs of connection platforms 110, 111, 112 and 113 are secured, these platforms 110 to 113 carrying hydraulic cylinders 114, 115, 116 and 117 in the downwardly inclined position. A connecting bar 118 is fastened between the ends of driving rods **114*a* and 115*a* of the outer hydraulic cylinders 114 and 115. To the lower surfaces on both ends of the connection bar 118, grippers 47, 48 for hoisting the dropper units or the warp breakage sensor are supported so as to be opened or closed by drive means, not shown. A connecting bar 121 is mounted between the ends of both drive rods 116*a* and 117*a* of the inner hydraulic cylinders 116 and 117. To both ends of the connecting bar 121, hoist arms 122 and 123 are clamp secured, as shown in FIG. 13, for adjustment in their mounting positions. Channel-shaped engaging members 51 and 52 for hoisting the heddles are threadedly attached to the foremost part of these hoist arms 122 and 123. The relative position between the grippers 47, 48 and the engaging members 51, 52 is set so as to be similar to that between a plurality of heddles 55A and the warp breakage sensor 49A on the loom 3**.

The distances between the supporting pins 94 and 95, the supporting shafts 98 and 99 and between the supupporting pins 108 and 109 are set to the same value, while the distances between the supporting pins 94 and 98, the supporting pins 98 and 108, the supporting pins 95 and 109, the supporting pins 99 and 109 and between the supporting pins 98 and 103 are also set to the same value. Thus these link arms 92, 93, 96, 97, 100 and 107 make up a parallel motion six-member link system and, with actuation of the driving link 101, the supporting link 107 performs a straight-forward parallel motion with respect to the supporting bar 90.

Figure 11:
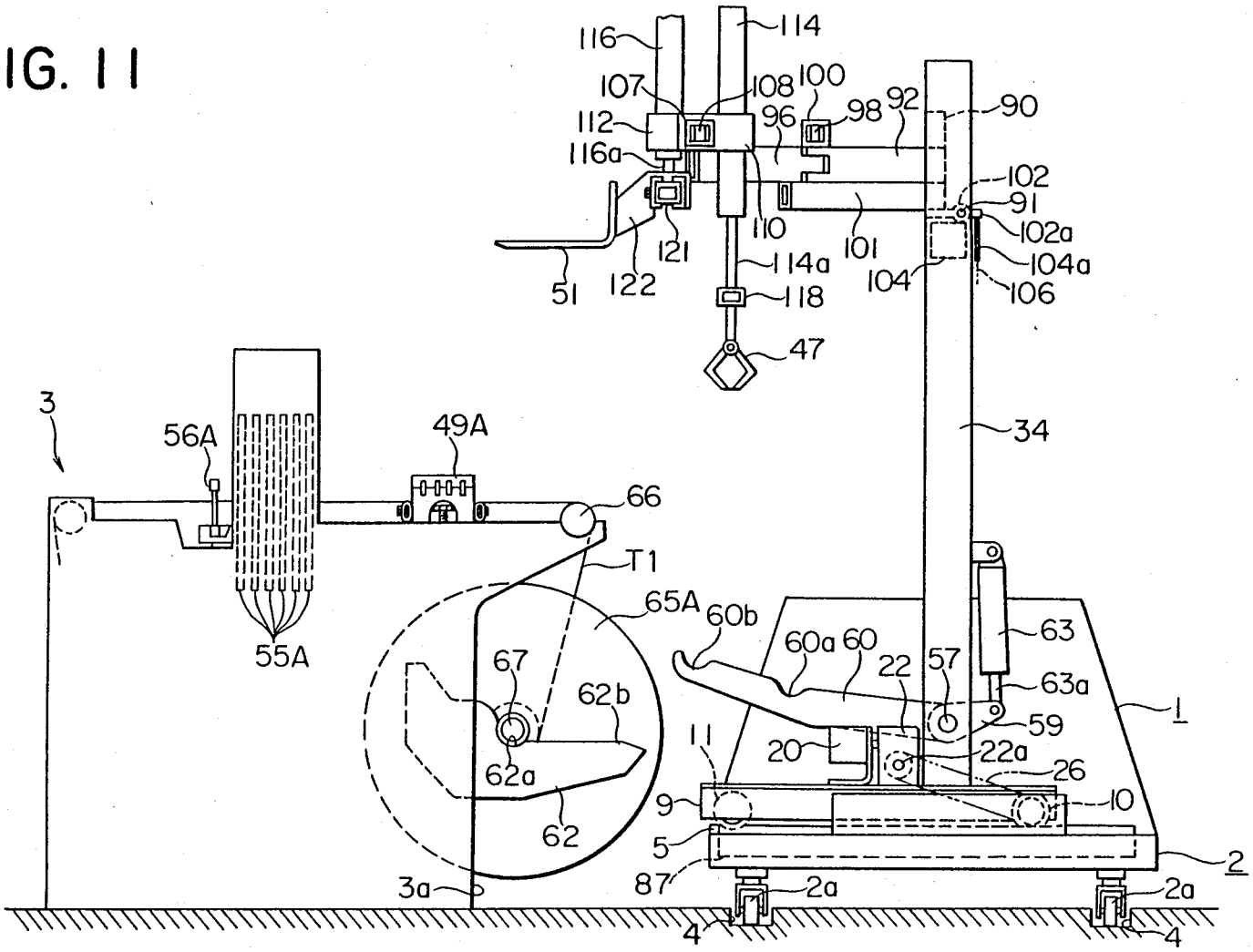
FIG. 11 is a diagrammatic side view showing a looming apparatus according to a modified embodiment of the present invention, the apparatus being shown at the working position relative to the loom.
Figure 12:
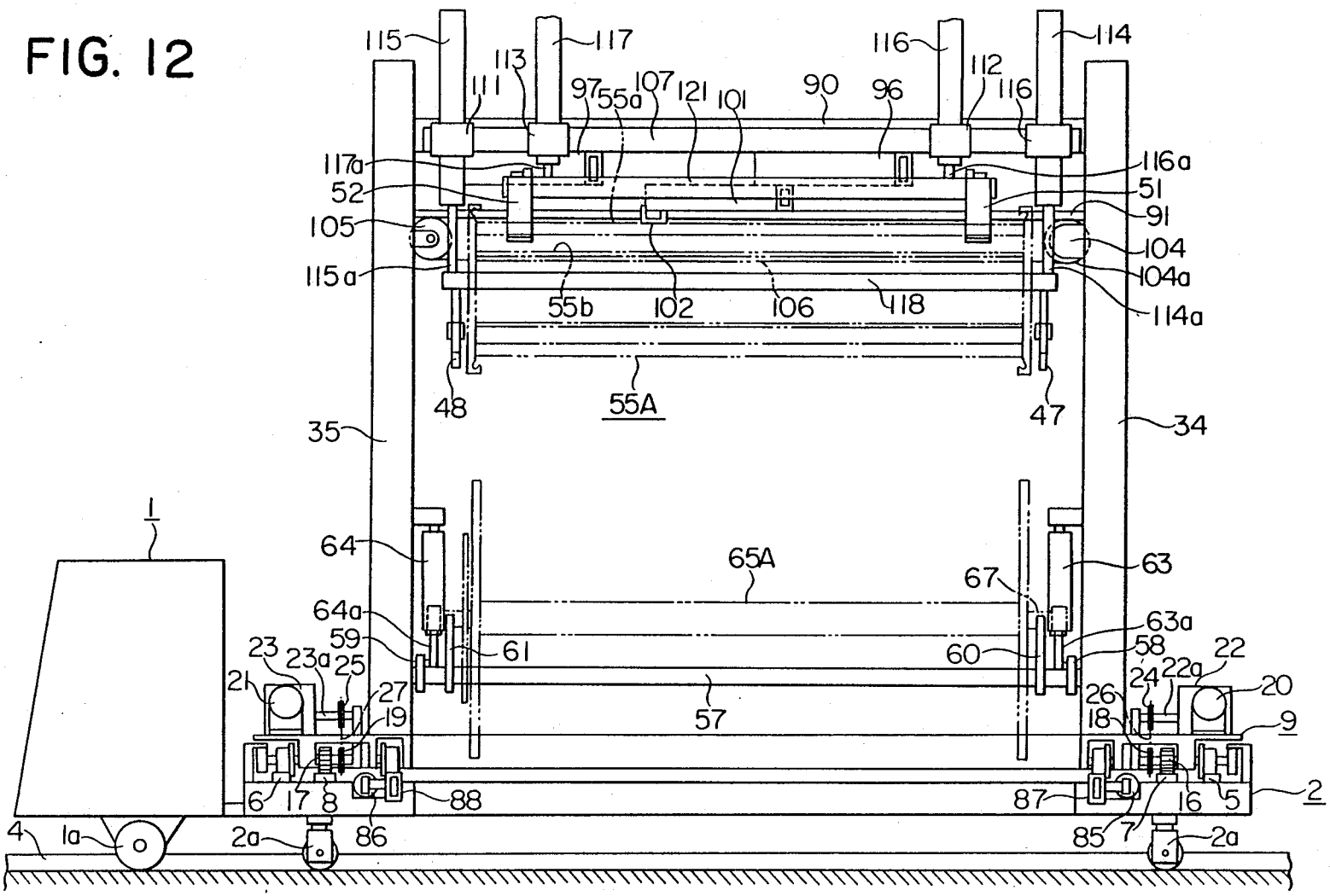
FIG. 12 is a front view of the looming apparatus shown in FIG. 11.

The operation of the looming apparatus of the present embodiment, in a situation in which the warp T1 supplied from the warp beam 65A mounted to and supported by the supporting bracket 62 and threaded by way of the back roller 66 through the warp breakage sensor 49A, heddles 55A and the reed 56A, as shown in FIG. 11, is used up, so that it becomes necessary to perform the looming operation, is hereafter explained.

The looming apparatus, so far kept in the ready chamber in the state shown in FIG. 11, is moved along the grooved rails 4 to a working position at the back of the loom 3, so that the supporting link 107 runs parallel to the heddles 55A. In this position, the hydraulic cylinders 85 and 86 are actuated so that the two movable rails 87 and 88 are placed between the truck 2 and the side frame **3*a* of the loom, with the front wheels 11 resting on these rails. The hydraulic motors 20 and 21 are then actuated in the normal direction so that the supporting platform 9 is moved from the stand-by position on the truck 2 towards the loom 3 along the fixed rails 5, 6 and the movable rails 87, 88. In the course of the movement of the supporting platform 9, the hydraulic cylinders 63 and 64 are actuated so that the supporting grooves 60***b* at the forward ends of the transfer levers 60 and 61 are lowered to below the warp beam shaft 67. Simultaneously, the hydraulic cylinders 114 and 115 are actuated so that the distal ends of the engaging members 51 and 52 are lowered to a height position between an upper rod 55*b* for heddle tensioning and a leveled upper frame 55*a* on the loom 3. In this state, the hydraulic motor 104 is driven in the normal direction so that the slider 102 is slid to the right from the position shown in FIG. 13. In this manner, the link arms 92, 93; 96, 97 are extended and the supporting link 107 performs a straight-forward translatory movement in the direction of the loom 3, as shown in FIG. 14, the engaging members 51 and 52 proceeding into a space between the upper frame 55*a* and the lower rod 55*b*.

When the heddles 55A as a whole are in a state that they can be placed on the engaging members 51 and 52, the heddles 56A are transported manually on the engaging members 51 and 52. By the operation of the hydraulic cylinders 114 and 115, the engaging members 51 and 52 are raised to a position indicated by the broken line in FIG. 15. By the operation peculiar to the six-member parallel motion link mechanism and the braking operation of the hydraulic motor 104, the parallelism of the supporting link 107 with respect to the heddles is maintained, so that the withdrawal of the heddles from the loom 3 is effected smoothly.

Figure 15:
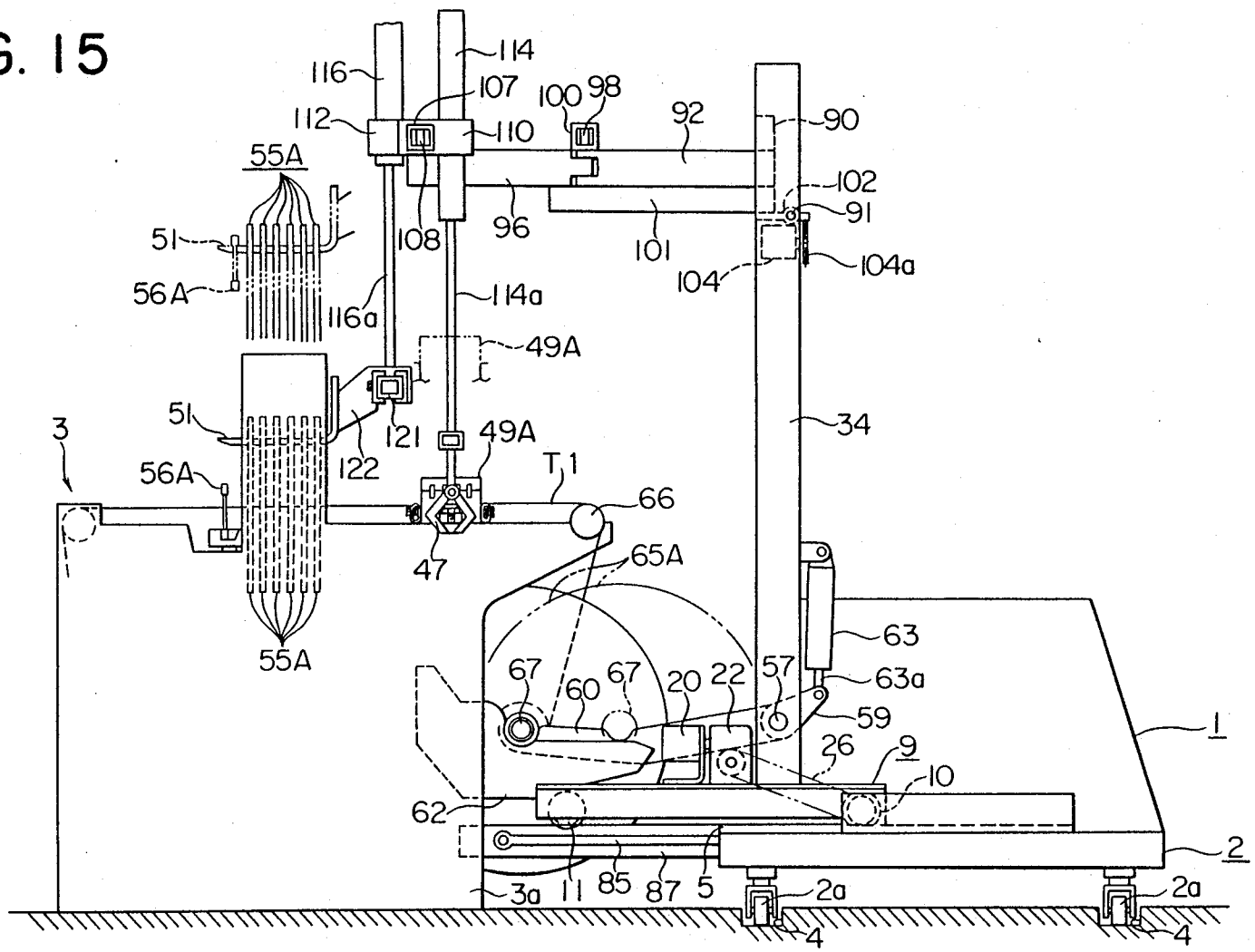
FIG. 15 is a side view showing the looming apparatus shown in FIG. 11, the apparatus being shown with the supporting platform moved to the looming position.

The hydraulic cylinders 116 and 117 are then actuated and the grippers 47 and 48 are lowered to the position for gripping the warp breakage sensor 49A as shown in FIG. 15. After being gripped by the grippers 47 and 48, the warp breakage sensor 49A is raised to the double-dotted chain-line position of FIG. 15 by the operation of the hydraulic cylinders 116 and 117.

Figure 14:
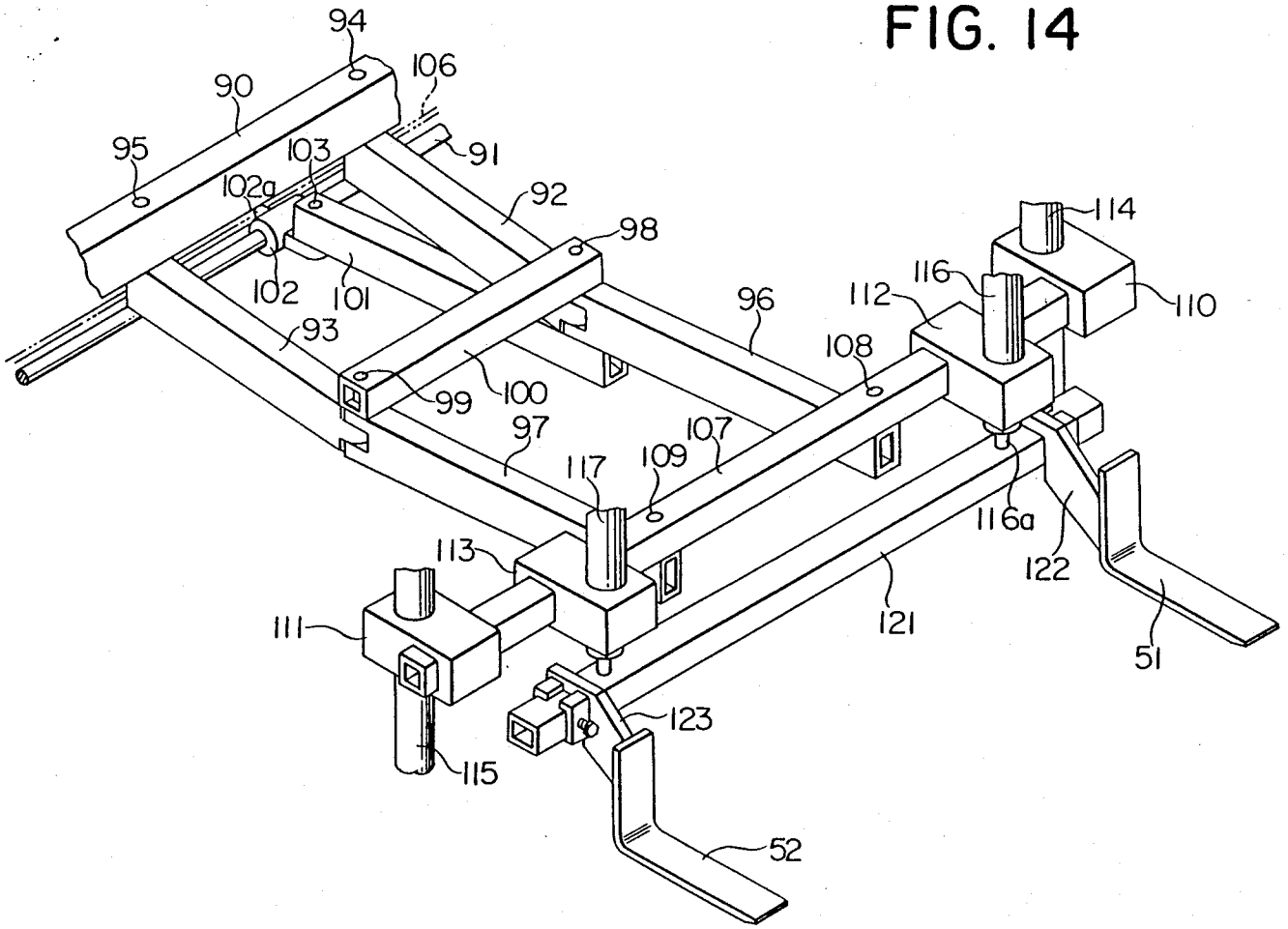
FIG. 14 is a perspective view showing essential parts of the link system in the extended state.

After the warp threading elements, namely the warp breakage sensor 49A, heddles 55A and the reed 56A are dismounted from the loom 3, and the hydraulic motor 104 is driven in reverse, the slider 102 is slid to the left from the position shown in FIG. 14. In this manner, the engaging members 51 and 52 are engaged with the heddles 55A to suspend them therefrom, the supporting link 107 making a straight-forward translatory movement to the original position shown in FIG. 13, with the grippers 47 and 48 gripping the warp breakage sensor 49A. Thus the link arm pair 92, 96 and the link arm pair 93, 97 performed only unidirectional deflection or displacement only in one direction with only a small space of deflection. In the course of such movement, the parallelism of the supporting link 107 relative to the warp beam 65 on the loom 3 is maintained, so that the warp yarn T2 reeled from the warp beam 65 is not deviated towards the warp beam shaft 67 to prevent the occurrence of warp entanglement.

Figure 16:
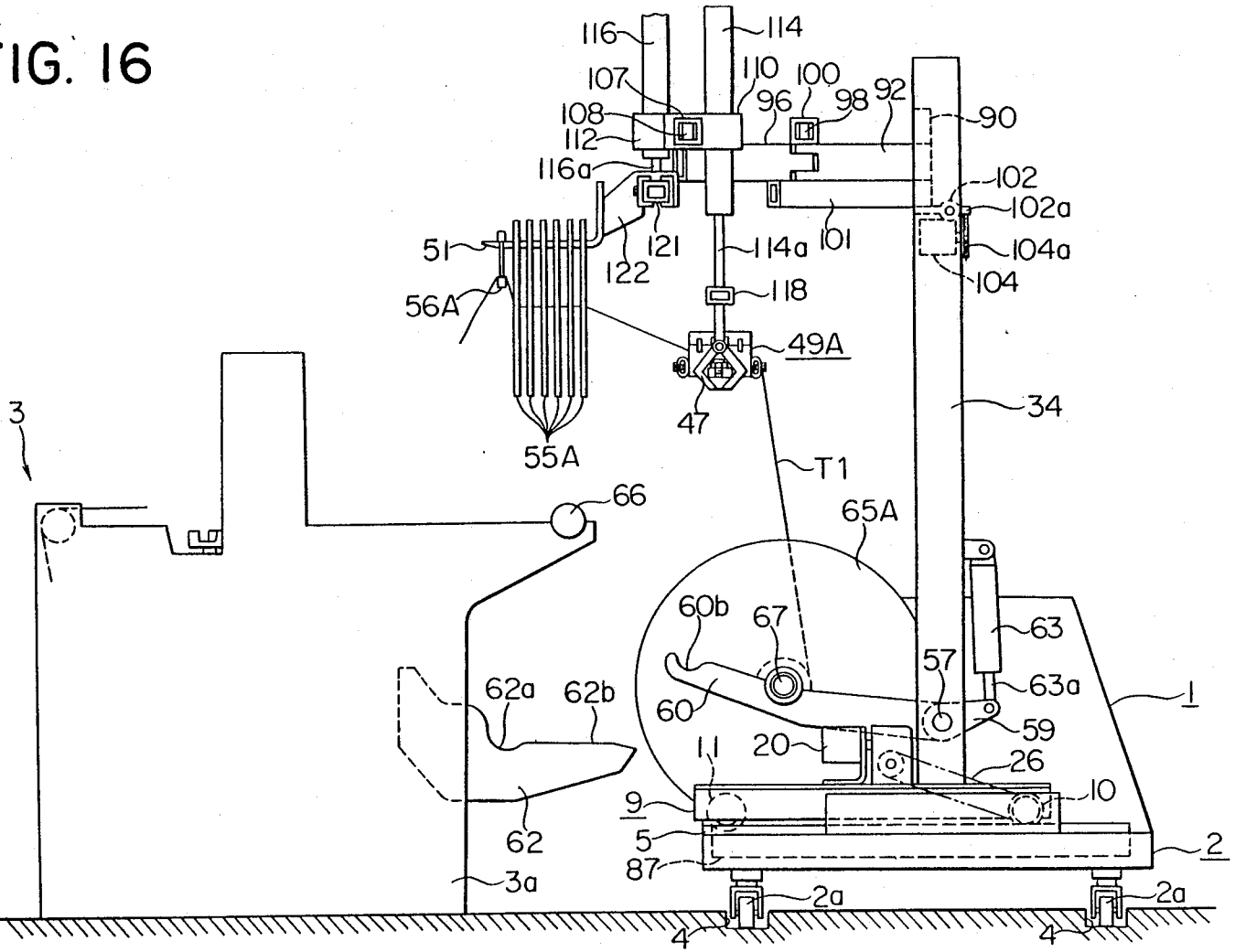
FIG. 16 is a side view showing the full warp beam and the elements threaded by the warp yarn, with the beam and the elements having been moved from the looming apparatus to the loom.

Then, by the operation of the hydraulic cylinders 63 and 64, the supporting grooves 60*b* of the transfer levers 60 and 61 are engaged with the warp beam shaft 67, as shown in FIG. 15. In this state, the hydraulic motors 20, 21 and the hydraulic cylinders 63, 64 are actuated so that the supporting platform 9 is moved a distance equal to the distance between the attachment position and the provisional position, while the supporting grooves 60*a* of the transfer levers 60 and 61 are engaged by the warp beam shaft 67 in the position of the broken line in FIG. 15. Then, as shown in FIG. 16, the supporting platform 9 that has received the warp threading elements 49A, 55A and 56A is returned to the stand-by position on the truck 2, while the movable rails 87 and 88 are returned to a stand-by position on the truck 2. The looming apparatus is moved into the ready chamber as it is towed by the unmanned towing vehicle 1. During this transport operation, the six-member parallel motion link unit remains stationary by the braking action of the hydraulic motor 104 and the parallelism of the six-member link system, so that the heddles 55A are held in a stable suspended state.

The transfer of the full warp beam and the elements threaded by the warp yarn, namely the warp sensor, heddles and the reed threaded by the warp from the full warp beam occurs with a sequence that is reversed from that described above. In this case, the heddles can be attached smoothly under the parallelism maintained by the six-member link system.

Therefore, in the embodiment shown in FIGS. 11 to 16, the front side straight-forward parallel motion link member of the six-member link system that makes up the heddles delivery means performs a straight-forward translatory movement relative to the body of the looming apparatus, while the delivery member attached to the link member is for a reciprocating straight-forward motion. Thus, when the working position of the looming apparatus is set with respect to the loom so that the front side straight-forward parallel motion link member runs parallel to the heddles attached to the loom, the link member always runs parallel to the heddles during the looming operation so that the engagement between the delivery member and the heddles, withdrawal of the heddles from the loom and the attachment of the heddles to the loom will be carried out smoothly. The six-member link system can be fixed by a simplified operation of fixing one of the link members so that stability of the heddles can be easily assured during transport or lifting of the heddles.

Figure 17:
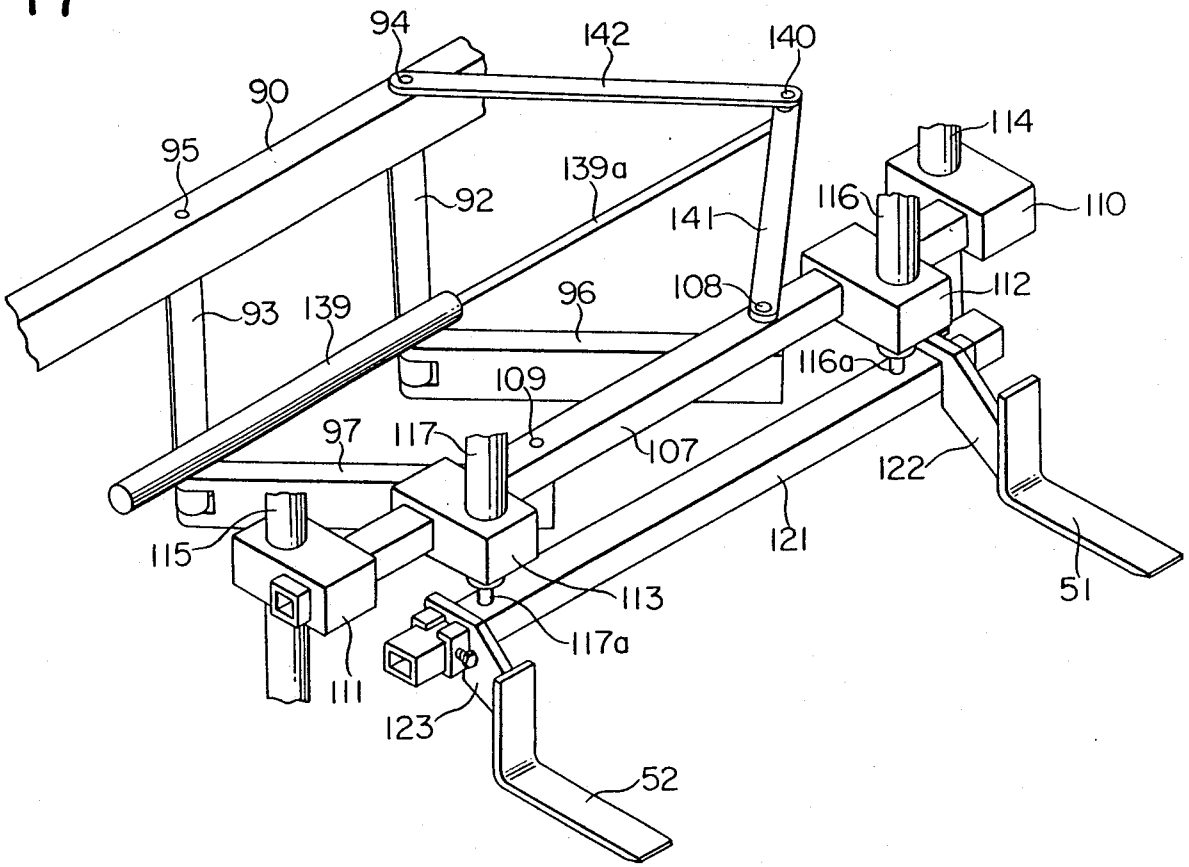
FIG. 17 is a perspective view showing a further modified embodiment of the looming apparatus according to the present invention.

The embodiment shown in FIGS. 11 to 16 may be replaced by an arrangement shown for example in FIG. 17 wherein a hydraulic cylinder 139 is used in place of the connecting link 100, an auxiliary link 141 is mounted between a supporting pin 108 on the supporting link 107 and the foremost supporting pin 140 of the driving shaft 139*a* of the cylinder, an auxiliary link 142 is mounted between the supporting pin 140 and the supporting pin 94 on the supporting bar 90 and the distances between the supporting pins 108 and 140, the supporting pins 94 and 140 and between the supporting pins 108 and 98 are set to the same value. In this modified embodiment, the supporting link 107 performs a straight-forward translatory movement, while the six-member parallel motion link system can be fixed by the locking operation of the driving rod 139*a*. Alternatively, the rack-pinion system or the gearing system may be used to provide for manual translatory movement of the six-member parallel motion system. Still alternatively, the engaging members may be replaced by grippers that are able to grip the heddles as a whole.

Although the dropper unit is used in any of the above described embodiments as the warp breakage sensor, the present invention may also be applied to a looming apparatus wherein the warp deviated from the warp threading means is detected by an optical system as the warp breakage sensor.

It is thought that the present invention and many of its attendant advantages will be understood from the foregoing description and it will be apparent that various changes may be made in the form, construction and arrangement thereof without departing from the spirit and scope of the invention or sacrificing all of its material advantages, the form hereinbefore described being merely a preferred or exemplary embodiment thereof.

What is claimed is:

1. A looming apparatus for a loom comprising a loom and a truck movable between a looming prepartory position and a predetermined position relative to said loom by running on a floor; means for handling a warp beam for attachment of a full warp beam to the loom and removal of an empty warp beam from the loom; means for handling elements including at least heddles and a reed, threaded by the warp yarns of said full warp beam; and a supporting platform mounted on said truck for horizontally sliding reciprocation between a stand-by position and a looming position by sliding on said truck, said supporting platform having mounted thereon said warp beam handling means and said means for handling elements threaded by the warp yarn; wherein in said stand-by position, said truck is movable between said looming preparatory position and said predetermined position; and in said looming position, said warp beam handling means and said handling means for said elements threaded by the warp yarn are respectively operative to mount said full warp beam to an dismount said empty warp beam from the loom and also to mount and dismount said elements to and from the loom.

2. A looming apparatus as claimed in claim 1, wherein said warp beam handling means includes a first warp beam handling mechanism for transferring the warp beam between a position for provisionally placing the warp beam in said loom and a position for placing the warp beam in said truck, and a second warp beam handling mechanism for transferring the warp beam between said position for provisionally placing the warp beam and a warp beam attachment position on the loom which is further away than said provisional position with respect to said warp beam placing position.

3. A looming apparatus as claimed in claim 2, wherein said warp beam attachment position and said provisional placing position are defined as first supporting grooves and second supporting grooves in a pair of supporting brackets provided on said loom with a spacing from each other and wherein said warp beam placing position is defined as third supporting grooves in a pair of transfer levers rotatably provided to a pair of upright supporting posts on said supporting platform.

4. A looming apparatus as claimed in claim 3, wherein a fourth supporting groove is formed at the forward end of each of said transfer levers at a spacing from said third supporting groove substantially equal to the spacing between said first and second supporting grooves and wherein warp beam transfer between said attachment position and said provisional placement position and between said provisional placement position and the placement position is carried out utilizing these supporting grooves.

5. A looming apparatus as claimed in claim 1, wherein auxiliary wheels are provided to said supporting platform for guiding the movement of said platform from said stand-by position to said looming position, said auxiliary wheels being capable of contacting the floor surface on which the truck travels.

6. A looming apparatus as claimed in claim 1, wherein warp tension adjustment means including rotational means is provided on said supporting platform, said rotational means engaging with said full warp beam and being operable to turn said full warp beam in one or the other direction as a function of the magnitude of the tension on the warp threaded from said full warp beam through said warp threading means.

7. A looming apparatus as claimed in claim 6, wherein said rotational means comprises a hydraulic motor and a friction roller pressured against a flange of said full warp beam for transmitting the rotation of said hydraulic motor to said full warp beam.

8. A looming apparatus as claimed in claim 7, wherein said warp tension adjustment means includes follow-up means for causing follow-up movement of said rotational means when said full warp beam is moved in order to be transferred from said warp beam placement position to said provisional placement position.

9. A looming apparatus as claimed in claim 8, wherein said follow-up means is a hydraulic motor.

10. A looming apparatus as claimed in claim 1, wherein said means for handling the warp threading means includes a six-member parallel-motion link system mounted to the upper ends of a pair of supporting posts mounted upright on said platform with a spacing from each other, and wherein said elements threaded by the warp yarn are vertically movably mounted to a link member at the front side of said link system performing a straight-forward translatory motion.

* * * * *